United States Patent [19]

Hauschke et al.

[11] 3,956,818

[45] May 18, 1976

[54] METHOD FOR SECURING A TUBE IN A PASSAGE OF A SUPPORT

[75] Inventors: Manfred Hauschke, Muennerstadt; Walter Hesse, Hilden; Volker Meissner, Remscheid-Lennep, all of Germany

[73] Assignee: Kotthaus & Busch, Remscheid, Germany

[22] Filed: Jan. 21, 1974

[21] Appl. No.: 435,125

[30] Foreign Application Priority Data

Jan. 15, 1973 Germany ..... 2301815

[52] U.S. Cl. ..... 29/523; 29/243.52; 72/370

[51] Int. Cl.[2] ..... B21D 39/00

[58] Field of Search ..... 29/523, 522, 243.52; 72/393, 392, 370, 367

[56] References Cited

UNITED STATES PATENTS

| | | | |
|---|---|---|---|
| 2,219,784 | 10/1940 | Maupin | 29/523 |
| 2,409,219 | 10/1946 | Maxwell | 29/523 |
| 2,736,950 | 3/1956 | Mathews | 29/523 |
| 2,737,996 | 3/1956 | Toth | 29/523 |
| 3,449,812 | 6/1969 | Hauschke et al. | 29/523 |
| 3,699,625 | 10/1972 | Spencer et al. | 29/523 |

*Primary Examiner*—C. W. Lanham
*Assistant Examiner*—James R. Duzan
*Attorney, Agent, or Firm*—Michael J. Striker

[57] ABSTRACT

A roller tool having material-deforming rollers the axis of rotation of which extends lengthwise of and forms an angle with the longitudinal axis of a tube to be secured, is inserted into that portion of the tube which is located within the confines of a passage of the support. The roller tool is then rotated in contact of its rollers with the inner circumferential surface of the tube, so as to form at one axial location of the tube a corresponding outward face deformation of the tube in the passage. During this time, axial displacement of the roller tool relative to the tube is prevented until the outward deformation has reached a desired dimension in direction radially outward of the tube. When this dimension is reached, the rotation of the roller tool is continued but the roller tool is now also permitted to advance axially of the tube so as to form a second outward deformation in the latter axially adjacent the first one. An apparatus for carrying out the method is also disclosed.

5 Claims, 3 Drawing Figures

METHOD FOR SECURING A TUBE IN A PASSAGE OF A SUPPORT

BACKGROUND OF THE INVENTION

The present invention relates generally to the securing of tubes in a passage of a support, and more particularly to a method of affording such securing and to an apparatus for carrying out the method.

Tubes must frequently be secured in a passage of a support, for instance a tube plate or the like. This is often required in heat exchangers, and very frequently is now demanded in the construction of reactors. In the latter instance, in particular, the region of the tube where the latter is mechanically deformed so as to be retained in the passage formed in the tube plate of the reactor, is subjected to very high stresses. Various ways of securing the tube by deforming it outwardly within the passage, have become known, such as the so-called Pilgrim-step method which is also known as the Mannesmann method, a quick-step rolling method, or an automatically operating rolling method. None of these, however, have been found to be satisfactory because in all instances it was observed that at least over a period of time fissures will develop in the material of the tube which has been expanded, such fissures being the result of stresses that have been set up during the expansion which is caused by rolling of the tube material. The fissures are found particularly at the juncture between the rolled portion of the tube and the non-rolled portion thereof. This is not tolerable, because the weakening of the material which is caused by the presence of these fissures can lead to a deterioration of the material strength to such an extent that the material will finally fail, with consequences which at the very least are disadvantageous in terms of down time, and which in the case of reactors can be downright disastrous.

SUMMARY OF THE INVENTION

Accordingly, it is an object of the present invention to overcome the disadvantages of the prior art. More particularly, it is an object of the present invention to provide an improved method of securing a tube in a passage of a support by expanding the tube within the passage, which is not possessed of the disadvantages of the prior art, wherein in particular the development of stress-caused fissures is eliminated.

Another object of the invention is to provide such an improved method which, nevertheless, will assure a reliable fluid-tight connection of the tube with the passage in which it is to be secured.

A further object of the invention is to provide an apparatus for carrying out the method.

In keeping with the above objects, and with others which will become apparent hereafter, one feature of the invention resides, in a method of securing a tube in a passage of a support by expanding the tube within the passage, in the steps of disposing in that portion of the tube which is located within the confines of the passage a roller tool having material-deforming rollers the axis of rotation of which extends lengthwise of but forms an angle with the longitudinal axis of the tube. The roller tool is then rotated about the axis of rotation, and the tool forms an inner annular recess in the tube at one axial location of the latter so that a corresponding outward first deformation of the tube occurs in the passage. As this takes place, axial shifting of the roller tool relative to the tool is prevented until the groove and the first deformation have their desired dimension in the direction radially of the tube. Upon reaching of this desired dimension, the rotation of the roller tool is continued but now the advancement of the latter in axial direction of the tube is permitted and the roller tool is used to form the tube with a second outward deformation.

The forming of the tube with the second outward deformation, as the tool is permitted to advance in axial direction of the tube, can be carried out according to any of the known methods, for instance the Pilgrim-step method or a continuous-advancement method well known to those having skill in the art.

Particularly if the Pilgrim-step method is utilized, it is advantageous to follow the second deformation with a third deformation during which the roller tool is again prevented from advancing axially of the tube, as during the initial operating step, and it is advantageous if the second outward deformation somewhat overlaps the first deformation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1A:
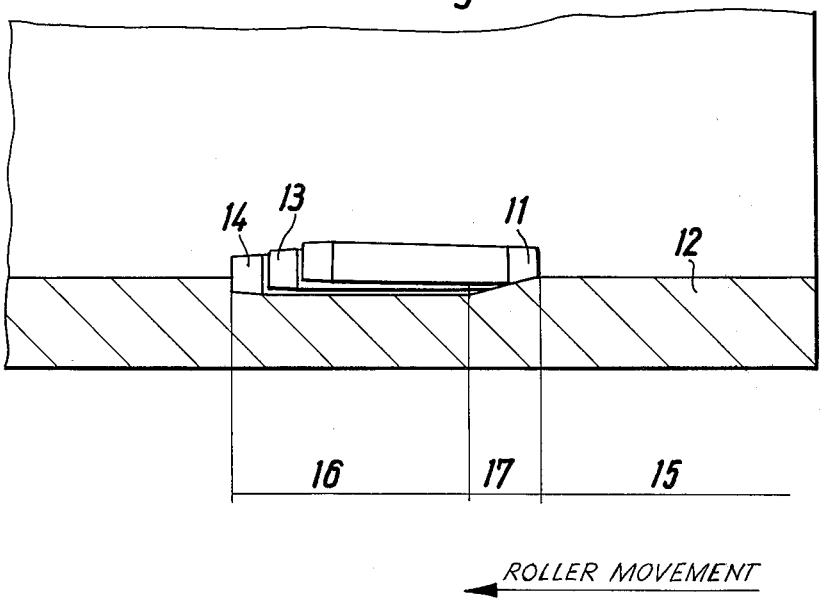
FIG. 1A is a diagrammatic fragmentary axial section through a tube which is to be deformed according to the Pilgrim-step method known from the prior art.
Figure 1B:
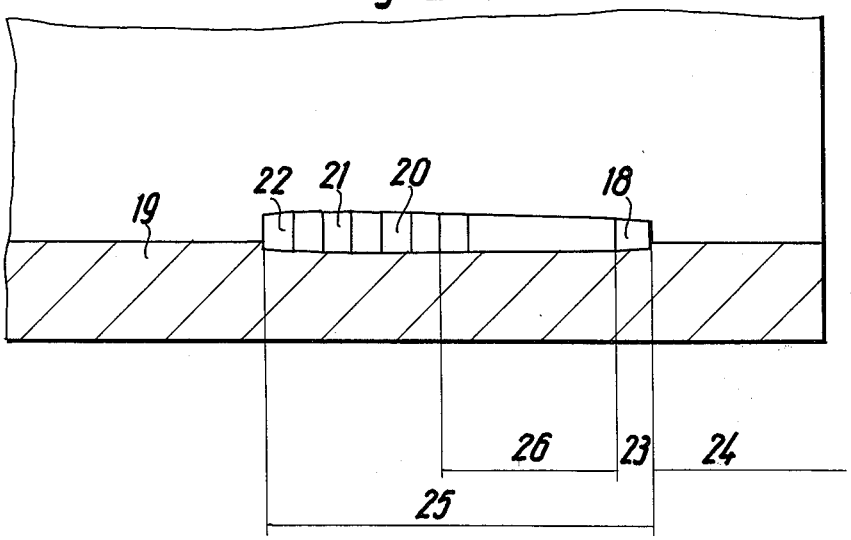
FIG. 1B is a view similar to FIG. 1, but showing the deformation in accordance with the present invention.

FIGS. 1A and 1B illustrate diagrammatically the operation which is performed as a tube is fluid-tightly secured in a passage of a support, by expanding the tube radially outwardly within the passage. Of course, it should be understood that in FIGS. 1A and 1B the support has not been shown, but only a portion of the tube. It will also be understood that as the inner surface of the tube is formed with a radially outward depression or groove, the outer surface will be formed with a corresponding outward deformation which has not been illustrated since it will be readily evident to those skilled in the art.

FIG. 1A illustrates the operation which is carried out if the tube is to be secured in a passage of a support in accordance with the prior-art so-called Pilgrim-step rolling method. According to this, the tube is identified with reference numeral 12, only a portion of its circumferential wall being shown. Located within the tube for deformation purposes is a pressure roller 11 which is pressed in radially outward direction against the inner surface bounding the tube wall 12, and as it is rotated it passes in a spiral path advancing from the position 11 via the position 13 to the position 14 during each of its rotations. In the position 14 the full outer expansion of the tube has been achieved and the roller is retracted or reversed. The Pilgrim-step rolling method is well known to those conversant with this field of art, but for further explanation reference may be had, if desired, to German Patent No. 1,289,018 wherein the method is described and illustrated in detail.

It has been found in actual practice that in the substantial-length portion 17 which connects the unrolled or undeformed part of the tube 12, which part is identified with reference numeral 15, with the rolled part that is identified with reference numeral 16, fissures inevitably develop due to internal tensions in the material resulting from the initiation of the rolling operation. The medium which subsequently will flow through such a tube can cause corrosion in the material into which it can enter due to the presence of these fissures, and over a period of time this can lead to the much-feared failing of the tube material.

Another method which is known from the prior art and is not separately illustrated herein, is the continuous rolling method. In this, also, the length of the portion 17 is such that the development of fissures cannot be prevented, so that the same disadvantages obtain as outlined with respect to FIG. 1A.

By contrast to this prior art, the invention which is diagrammatically explained in FIG. 1B completely avoids these disadvantages. The portion of the tube wall is identified with reference numeral 19 in this Figure, and the roller is identified with reference numeral 18. The initial deformation of the material of the tube wall 19 takes place with the roller 18 in the illustrated position. At this time, the roller 18 is prevented from movement axially of the tube but is rotated and pressed against the inner surface of the tube wall until such time as the desired outward deformation of the tube wall has been achieved. In other words, at this time the roller 18 is made to penetrate into the material of the tube wall 19 to the same extent to which the roller 11 will have penetrated in FIG. 1A when it reaches the position 14.

Once this depth of penetration has been reached, the rotation of the roller 18 is continued but the roller is now permitted to shift axially of the tube 19, that is towards the left as indicated by the arrow associated with FIG. 1A as well as FIG. 1B. This movement may for instance be in accordance with the above-discussed Pilgrim-step method, or it may be in accordance with the continuous rolling method or the like. The roller 18 will now progressively assume the positions 20, 21 and 22 which is the terminal position. It is clear from FIG. 1B that the length of the portion 23 which corresponds to the portion 17 of FIG. 1A, that is the portion which forms the juncture between the un-deformed part 24 of the tube and the deformed part 25, is substantially shorter than the length of the portion 17 in FIG. 1A. Because of this substantial shortenings, it has been found that fissures due to internal stresses can no longer develop, thus avoiding the disadvantages of the prior art.

It is advantageous if the first portion of the subsequent roller operation, for instance the portion identified by the position 20 for the roller if it is assumed that the subsequent rolling operation is in accordance with the Pilgrim-step method, will be overlapping the portion 26 in which the roller 18 will have performed the deformation of the tube wall 19 without being permitted to advance axially. When the terminal position 22 is reached, the roller 18 is advantageously again fixed against axial movement with respect to the tube, and the final deformation then takes place.

Figure 2:
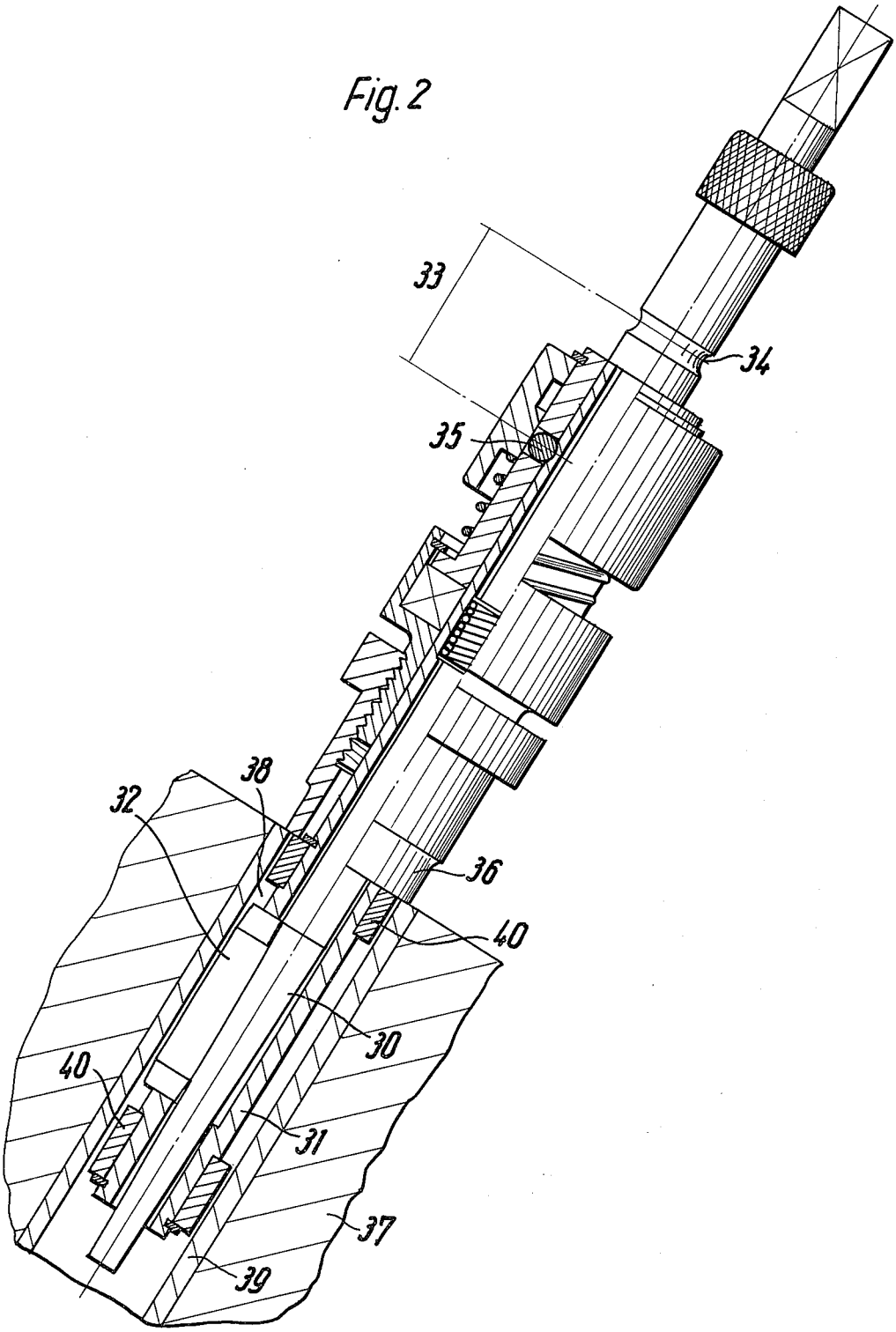
FIG. 2 is a diagrammatic axial section through a roller tool constituting an apparatus of the present invention, and through portions of a tube and a support in which the tube is to be secured.

FIG. 2 shows an apparatus for carrying out the novel method which has been explained above with respect to FIG. 1B. Reference numeral 37 identifies a support, such as a tube plate or the like, which is of course shown only fragmentarily and will be understood to be provided with a plurality of passages (only one shown), each of which is to have a tube or pipe 39 (only one shown) fluid-tightly secured in it.

The apparatus of FIG. 2 serves the purpose of providing for such fluid-tight securement. It uses a conically tapering mounting member 30 which is rotatable and is surrounded by a rotatable roller cage 31. Mounted in the roller cage 31 for rotation relative thereto and also therewith are three pressure rollers 32 the longitudinal axes of which are inclined forwardly with respect to the longitudinal axis of the mounting member 30. Due to this inclination, rotation of the roller cage and the rollers 32 will tend to advance both of them as well as the mounting member 30 in axial direction of the latter, that is downwardly in FIG. 2 and axially of the pipe 39.

The rearward portion of the mounting member 30, which extends out of the pipe 39, is provided with a plurality (for instance 2, as shown) of circumferential grooves 34 which are spaced from one another by the distance 33. A sleeve-like abutment 36 surrounds the mounting member 30 outside of the tube 39 and balls 35 are provided which serve as retaining balls and which are selectively receivable in one or the other of the grooves 34, so as to lock the retaining or abutment sleeve 36 in place on the mounting member 30 in one of two axially displaced positions.

In FIG. 2, the member 36 contacts the outer end of the plate 37 and thus prevents the member 30 with the cage 31 and the rollers 32 from advancing axially into the bore 38 of the tube 39. In this position, the rollers 32 are rotated in contact with the inner circumferential surface bounding the bore 38 of the tube 39, until the recess formed in this surface and the corresponding outward deformation of the material of the tube 39 have reached the desired dimension. Thereupon, the member 36 is disengaged and shifted rearwardly (upwardly in FIG. 2) until the balls 35 are received in the upper one of the grooves 34. The member 36 is now retracted from the plate 37, and continued rotation of the rollers 32 will now result in an automatic advancement of the rollers 32, the cage 31 and the mounting member 30 in forward (downward in FIG. 2) direction. This advancement can take place according to the Pilgrim-step method or the like. In any case it continues until the member 36 again moves into abutment with the plate 37, at which time rotation again continues but the axial movement is prevented, and thus at the terminal end of the recess the depth of the recess is again increased without axial movement taking place, until the desired depth has been reached. Once this is done, the securing of the tube 39 in the bore or passage of the plate 37 is completed.

It should be understood that the grooves 34 could be replaced by other coupling means as long as they permit the positioning of the member 36 at selected axially spaced locations of the mounting member 30.

Rings 40 of synthetic plastic material, for instance nylon or the like, surround the member 30 and serve to guide it in the bore 38 of the tube 39, journalling the member 30 without incurring the danger that ferritic particles might become worn off.

The configuration of the rollers 32 can be selected at will, or as dictated by particular requirements.

It is advantageous if the torque transmitted to the member 30 at those times at which it does not advance axially, is greater than at other times at which axial advancement does take place, because greater torque is required at these times in order to assure —due to the contact of the rollers 32 over their entire length with the inner surface bounding the bore 38— that proper deformation takes place.

The radially outward deformation can be uniform over the entire length over which deformation takes place, or it can be non-uniform, for instance the deformation can be greater at the beginning and at the end than in the middle, or vice versa.

It is self-evident that the present invention can also be used with a roller cage and rollers which are retracted rather than advanced.

It is a particular advantage of the present invention that a single apparatus is capable of carrying out the deformation of the material of the tube in such a manner as to not only provide for the advantages of the prior-art method, but also to avoid the disadvantages, in particular the formation of any kind of fissures caused due to internal stresses in the tube material. Such fissures were completely unavoidable heretofore when resort was had to the prior art. In many instances, such as in the case of reactor constructions, such fissures are, however, completely unacceptable because of the dangers which they pose, and it is one of the substantial contributions of the present invention that it makes it possible to completely avoid the formation of such fissures.

It will be understood that each of the elements described above, or two or more together, may also find a useful application in other types of constructions differing from the types described above.

While the invention has been illustrated and described as embodied in an apparatus for securing a tube in a passage of a support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim:

1. In a method of securing a tube in a passage of a support by expanding the tube within the passage, the steps of disposing in that portion of the tube which is located within the confines of said passage a roller tool having material-deforming rollers the axis of rotation of which extends lengthwise of but forms an angle with the longitudinal axis of the tube; rotating said roller tool about said axis of rotation in a single circumferential direction and forming with it an inner annular recess in said tube at one axial location of the latter so that a corresponding outward first deformation of the tube occurs in said passage; restraining said roller tool against displacement relative to said tube in both axial directions of said tube until said groove and said first deformation have reached a desired dimension in direction radially of said tube; terminating the step of restraining upon reaching of said desired dimension; and continuing said rotation of said roller tool in said single circumferential direction so that the roller tool now advances axially of the tube due to termination of the restraining step and forms said tube with a second outward deformation.

2. In a method as defined in claim 1, wherein said advancement of said roller tool in axial direction of said tube takes place in accordance with the pilgrim-step method.

3. In a method as defined in claim 2; and further comprising the terminal steps of again restraining said roller tool against axial displacement with reference to said tube when said roller tool reaches an other axial location which is spaced from said one axial location; and rotating said roller tool about said axis of rotation to form an other inner annular recess in said tube at said other axial location, so that a corresponding third outward deformation of the tube occurs.

4. In a method as defined in claim 1; and further comprising the step of varying the torque transmitted to said roller tool during the second and fifth steps, so as to achieve uniform outward deformation of said tube.

5. In a method as defined in claim 1; wherein the dimensions of said first and second outward deformations in direction radially of said tube differ from one another.

* * * * *